US011710594B2

(12) United States Patent
Nakai et al.

(10) Patent No.: US 11,710,594 B2
(45) Date of Patent: Jul. 25, 2023

(54) FERRITE CORE AND WINDING COIL COMPONENT

(71) Applicant: Murata Manufacturing Co., Ltd., Kyoto-fu (JP)

(72) Inventors: Norihiro Nakai, Nagaokakyo (JP); Nobuyuki Fujisawa, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 332 days.

(21) Appl. No.: 17/009,900

(22) Filed: Sep. 2, 2020

(65) Prior Publication Data

US 2021/0065953 A1 Mar. 4, 2021

(30) Foreign Application Priority Data

Sep. 3, 2019 (JP) ..... 2019-160000

(51) Int. Cl.

| | |
|---|---|
| ***H01F 17/04*** | (2006.01) |
| ***H01F 41/02*** | (2006.01) |
| ***H01F 27/30*** | (2006.01) |
| *H01F 1/34* | (2006.01) |

(52) U.S. Cl.

CPC ..... *H01F 17/041* (2013.01); *H01F 27/306* (2013.01); *H01F 41/0246* (2013.01); *H01F 1/344* (2013.01)

(58) Field of Classification Search

USPC ..... 336/130, 221, 183, 233

See application file for complete search history.

(56) References Cited

U.S. PATENT DOCUMENTS

| | | | | |
|---|---|---|---|---|
| 10,884,077 | B2 * | 1/2021 | Hamamura | H01F 27/28 |
| 2007/0063804 | A1 * | 3/2007 | Watanabe | H01F 3/10 336/83 |
| 2013/0200972 | A1 * | 8/2013 | Wada | H01F 27/022 29/605 |
| 2014/0009252 | A1 * | 1/2014 | Samata | H01F 27/255 336/83 |
| 2017/0330676 | A1 * | 11/2017 | Uchida | H01F 27/292 |
| 2019/0172623 | A1 * | 6/2019 | Ito | H01F 17/045 |

FOREIGN PATENT DOCUMENTS

| | | | |
|---|---|---|---|
| JP | H11-233330 | A | 8/1999 |
| JP | 2004-111841 | A | 4/2004 |
| JP | 2013-045927 | A | 3/2013 |
| JP | 2017-145175 | A | 8/2017 |
| JP | 2017-204595 | A | 11/2017 |

* cited by examiner

*Primary Examiner* — Shawki S Ismail
*Assistant Examiner* — Kazi S Hossain
(74) *Attorney, Agent, or Firm* — Studebaker & Brackett PC

(57) ABSTRACT

A ferrite core includes a ferrite sintered body in which integrally formed are a winding core portion, extending in a lengthwise direction, and flange portions provided at both ends in the lengthwise direction of the winding core portion and projecting from the winding core portion in at least a height direction orthogonal to the lengthwise direction. Pores are present inside the winding core portion and the flange portions, and an abundance ratio of the pores in the winding core portion is equal to or more than about 0.05% and equal to or less than about 1.00% (i.e., from about 0.05% to about 1.00%).

20 Claims, 5 Drawing Sheets

POROSITY 0.1%

POROSITY 0.4%

POROSITY 2.4%

POROSITY 3.0%

FERRITE CORE AND WINDING COIL COMPONENT

CROSS-REFERENCE TO RELATED APPLICATION

This application claims benefit of priority to Japanese Patent Application No. 2019-160000, filed Sep. 3, 2019, the entire content of which is incorporated herein by reference.

BACKGROUND

Technical Field

The present disclosure relates to a ferrite core that provides a winding core portion on which a winding wire is to be disposed in a winding coil component or the like, for example, and a winding coil component including the stated ferrite core, and the present disclosure particularly relates to improvements for enhancing mechanical strength and magnetic permeability of a ferrite core including a ferrite sintered body.

Background Art

For example, Japanese Unexamined Patent Application Publication No. 2017-204595 discloses a ceramic core including a winding core portion (shaft core portion) extending in a lengthwise direction, and flange portions provided at both ends in the lengthwise direction of the winding core portion and projecting from the winding core portion in a height direction orthogonal to the lengthwise direction and in a width direction orthogonal to both the lengthwise direction and the height direction.

In the technique disclosed in Japanese Unexamined Patent Application Publication No. 2017-204595, attention is not paid to an abundance ratio itself of pores in the ceramic core, but paid to a difference between an abundance ratio of pores in the winding core portion and an abundance ratio of pores in the flange portions. In general, the abundance ratio of pores in the flange portions is greater than the abundance ratio of pores in the winding core portion, and it is preferable for a difference between the above abundance ratios to be within about 20%, more preferable to be within about 15%, and most preferable to be within about 10%.

In paragraph 0044 of Japanese Unexamined Patent Application Publication No. 2017-204595, it is described that, as described above, by causing the abundance ratio of pores in the flange portions to be closer to the abundance ratio of pores in the winding core portion, it is possible to suppress a decrease in strength of the flange portions.

In Japanese Unexamined Patent Application Publication No. 2017-204595, as discussed above, attention is paid only to the difference between the abundance ratio of pores in the winding core portion and the abundance ratio of pores in the flange portions, and any specific value of the abundance ratio of pores (hereinafter referred to as "porosity" in some case) itself in the ceramic core is not clearly written. However, the inventors of the present disclosure have recognized, through the experience, that the porosity of a ceramic core is usually not below about 2.0%.

In a ceramic core, when the porosity is high, mechanical strength thereof is lowered. It has been found that, in a ceramic core where a dimension in a lengthwise direction and a dimension in a width direction are below about 5.0 mm, such as 4.5 mm in the lengthwise direction and 3.2 mm in the width direction, for example, the mechanical strength is lowered and the degree of freedom in design of the core shape is limited in a case where the porosity is equal to or more than about 2.0%. In particular, from the viewpoint of downsizing and maintaining the characteristics, although the ferrite core is reduced in size, the diameter of a wire wound around the ferrite core is not changed. Under such circumstances, in the case where it is attempted to wind the wire, which is relatively thick with respect to the ferrite core, around the winding core portion without projecting the wire from a flange portion, the winding core portion may be made thinner with respect to the flange portion. However, such a downsizing approach may reach the limits. In order to lower the porosity, it is conceivable to increase the pressure to be applied during the molding of a ceramic core. However, it is difficult to increase the pressure during the molding of a ceramic core particularly when the dimension in the lengthwise direction and the dimension in the width direction thereof are below about 5.0 mm, as discussed above.

As described above, at present, it is significantly difficult to make the porosity of a ceramic core less than 2.0%, for example.

In the case where a ceramic core is formed of a magnetic material such as ferrite, there arises a problem that, when the porosity is high, the magnetic permeability is decreased and the characteristics of a coil component using the ceramic core are also deteriorated.

SUMMARY

Thus, the present disclosure provides a ceramic core made of ferrite that is able to achieve high mechanical strength and high magnetic permeability, that is, provide a ferrite core and a winding coil component including the ferrite core.

A ferrite core according to preferred embodiments of the present disclosure includes a ferrite sintered body in which integrally formed are a winding core portion, extending in a lengthwise direction, and flange portions provided at both ends in the lengthwise direction of the winding core portion and projecting from the winding core portion in a height direction orthogonal to the lengthwise direction. Also, pores are present inside the winding core portion and the flange portions.

In the stated ferrite core, an abundance ratio of the pores in the winding core portion is equal to or more than about 0.05% and equal to or less than about 1.00% (i.e., from about 0.05% to about 1.00%) in preferred embodiments of the present disclosure.

A winding coil component according to preferred embodiments of the present disclosure includes the ferrite core described above and also includes a winding wire disposed on the winding core portion.

Other features, elements, characteristics and advantages of the present disclosure will become more apparent from the following detailed description of preferred embodiments of the present disclosure with reference to the attached drawings.

BRIEF DESCRIPTION OF THE DRAWINGS

FIG. 8A shows a cross section of a ferrite sintered body with a porosity of about 0.1%, FIG. 8B shows a cross section of a ferrite sintered body with a porosity of about 0.4%, FIG. 8C shows a cross section of a ferrite sintered body with a porosity of about 2.4%, and FIG. 8D shows a cross section of a ferrite sintered body with a porosity of about 3.0%.

DETAILED DESCRIPTION

First Embodiment

Figure 1:
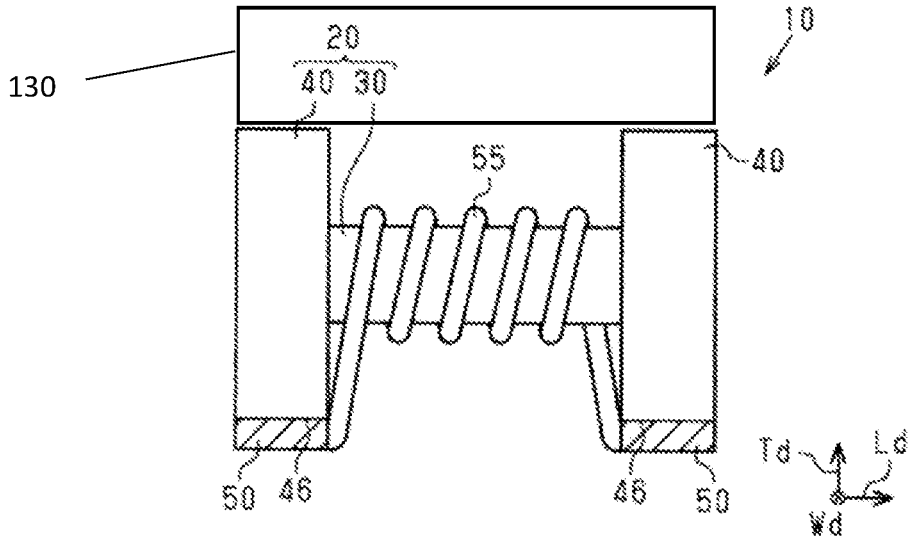
FIG. 1 is a front view illustrating a coil component including a ferrite core according to a first embodiment of the present disclosure.

As illustrated in FIG. 1, a winding coil component 10 includes a ferrite core 20, terminal electrodes 50, and a winding wire 55. The ferrite core 20 includes a ferrite sintered body in which a winding core portion 30 and a pair of flange portions 40 provided at both ends of the winding core portion 30 are integrally formed. As described above, since the ferrite sintered body itself is the ferrite core 20, in the following description, a reference symbol "20" used for referencing the ferrite core is also used for referencing the ferrite sintered body.

Figure 2:
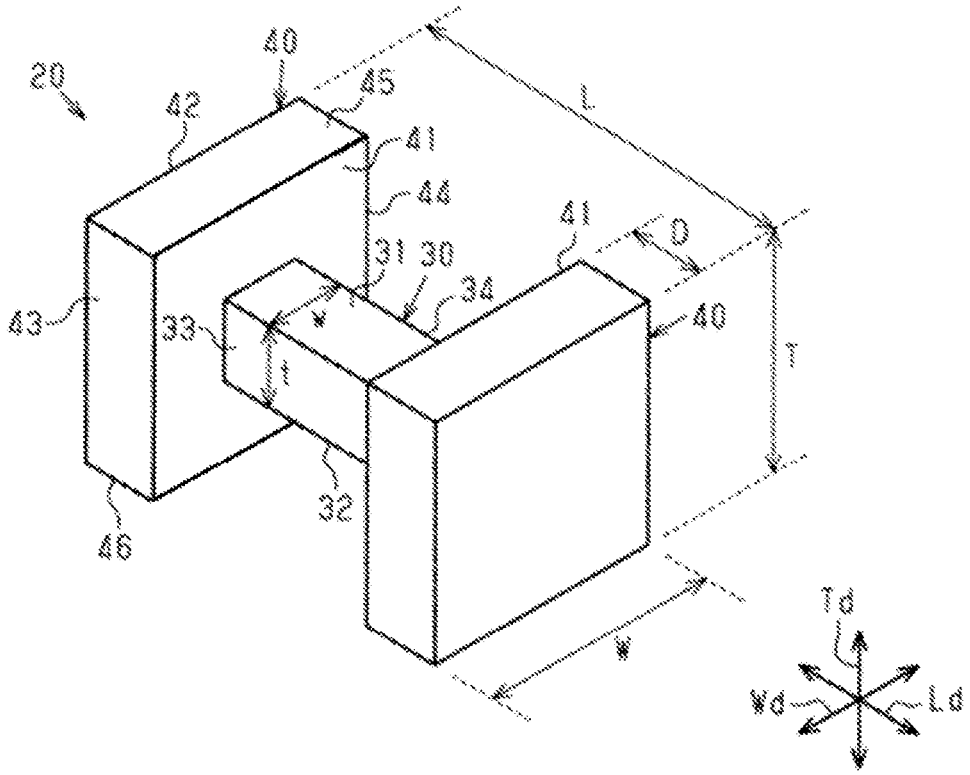
FIG. 2 is a perspective view illustrating the ferrite core alone included in the coil component illustrated in FIG. 1.

Here, as illustrated in FIG. 1 and FIG. 2, for example, a direction in which the pair of flange portions 40 is arranged is defined as a "lengthwise direction Ld"; of the directions orthogonal to the "lengthwise direction Ld", an up-down direction in FIGS. 1 and 2, that is, a direction orthogonal to a forming direction of the terminal electrodes 50 (a principal surface direction of a mounting substrate) is defined as a "height direction Td", and a direction orthogonal to both the "lengthwise direction Ld" and the "height direction Td" and also parallel to the forming direction of the terminal electrodes 50 (the principal surface of the mounting substrate) is defines as a "width direction Wd".

The winding core portion 30 has a quadrangular prism shape extending in the lengthwise direction Ld. The central axis line of the winding core portion 30 extends parallel to or substantially parallel to the lengthwise direction Ld. The winding core portion 30 has an upper surface 31 and a lower surface 32 facing opposite directions to each other in the height direction Td and extending in parallel to each other, and has a pair of side surfaces 33 and 34 facing opposite directions to each other in the width direction Wd and extending in parallel to each other.

The "quadrangular prism shape" includes a quadrangular prism with chamfered corners and ridge lines, a quadrangular prism with rounded corners and ridge lines, and the like. Unevenness or the like may be formed in part or all of the upper surface 31, the lower surface 32, and the side surfaces 33, 34.

The pair of flange portions 40 is provided at both ends in the lengthwise direction Ld of the winding core portion 30. Each flange portion 40 is formed in a rectangular parallelepiped shape having a relatively short lengthwise dimension when measured in the lengthwise direction Ld. Each flange portion 40 is so formed as to project from the winding core portion 30 in the height direction Td and in the width direction Wd.

The flange portion 40 may project from the winding core portion 30 only in the height direction Td, and may not project in the width direction Wd. That is, side surfaces 43 and 44 of the flange portion may be flush with the side surfaces 33 and 34 of the winding core portion 30, respectively. Note that, when the flange portion 40 is formed to project from the winding core portion 30 both in the height direction Td and in the width direction Wd as described above, the ferrite core 20 has a more complicated shape, and thus the ferrite core 20 is more likely to be broken. As such, it is more meaningful to obtain an enhancement effect of the mechanical strength.

Each flange portion 40 has a pair of end surfaces 41 and 42 facing opposite directions to each other in the lengthwise direction Ld and extending parallel to each other, a pair of side surfaces 43 and 44 facing opposite directions to each other in the width direction Wd and extending parallel to each other, and an upper surface 45 and a lower surface 46 facing opposite directions to each other in the height direction Td and extending parallel to each other. An end portion of the winding core portion 30 is located at the end surface 41, which is one of the paired end surfaces described above. The end surface 41 of each of the flange portions 40 faces inward to oppose the end surface 41 of the other flange portion 40, and is arranged in parallel to each other. The end surface 42, which is the other one of the paired end surfaces, faces outward.

As illustrated in FIG. 1, the terminal electrodes 50 are each provided on the lower surface 46. The terminal electrode 50 is electrically connected to a conductive land of a circuit substrate, for example, when the coil component 10 is mounted on the mounting substrate. At this time, since the lengthwise direction of the winding core portion 30 is parallel to the mounting substrate, it is possible to constitute the winding coil component 10 having a high Q value.

As illustrated in FIG. 1, the winding wire 55 is wound around the winding core portion 30. The winding wire 55 has a structure in which a core wire containing a conductive metal such as Cu or Ag as a conductive ingredient is covered with an electrically insulating material such as polyurethane or polyester. The diameter of the winding wire 55 is, for example, about 20 μm. Both end portions of the winding wire 55 are electrically connected to the terminal electrodes 50, respectively.

In order to manufacture the above-discussed ferrite core 20 and the coil component 10 including the ferrite core 20, the following processes are carried out, for example.

Figure 3:
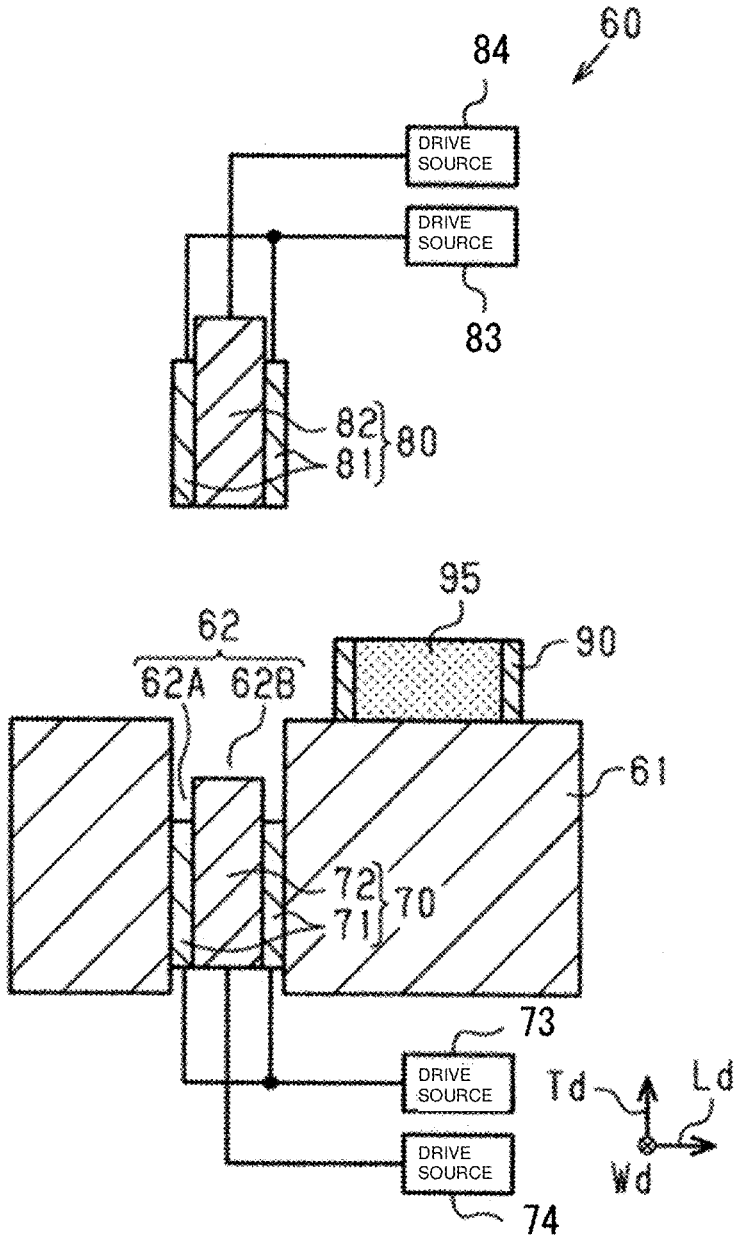
FIG. 3 is a schematic cross-sectional view illustrating a powder molding apparatus for achieving the ferrite core illustrated in FIG. 2.
Figure 4:
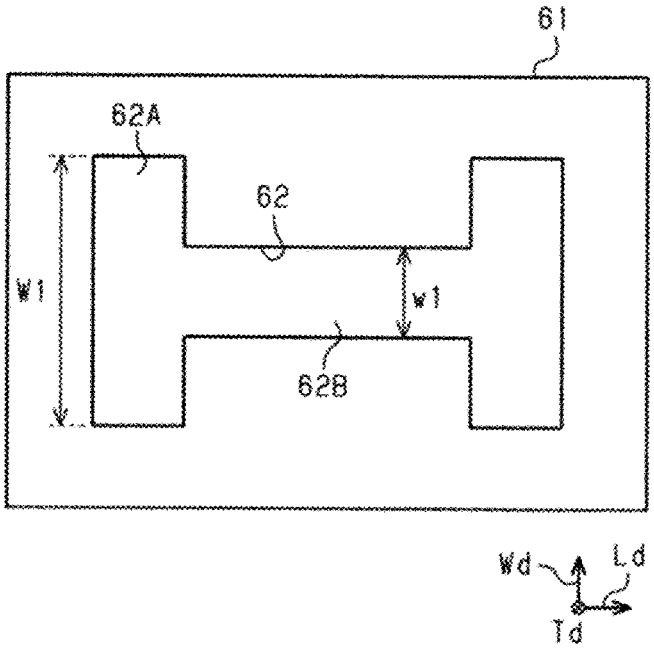
FIG. 4 is a plan view illustrating a die included in the powder molding apparatus illustrated in FIG. 3.
Figure 5:
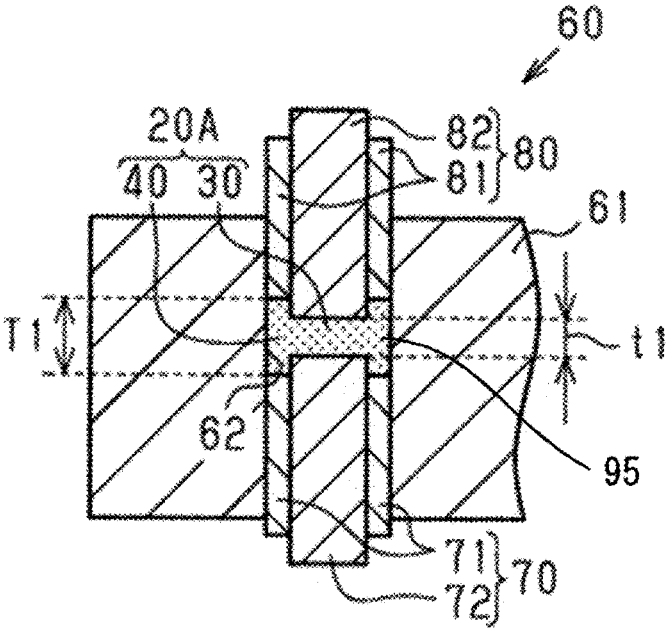
FIG. 5 is a schematic cross-sectional view illustrating a stage in which the molding of a molded body for the ferrite core has been finished by the powder molding apparatus illustrated in FIG. 3.

First, a ferrite powder is prepared, and the ferrite powder is pressure-molded to produce a molded body containing the ferrite powder. In this molding process, for example, a powder molding apparatus 60 as illustrated in FIGS. 3 to 5 is used. The powder molding apparatus 60 is described in detail in Japanese Unexamined Patent Application Publication No. 2017-204595 discussed above.

As illustrated in FIG. 3, the powder molding apparatus 60 includes a die 61, a lower punch assembly 70, an upper punch assembly 80, and a feeder 90.

A cavity 62 is formed passing through in the height direction Td in the die 61. As illustrated in FIG. 4, an opening of the cavity 62 has an H shape, which is substantially the same as a planar shape of the ferrite core 20 illustrated in FIG. 2, when viewed in the height direction Td. That is, the cavity 62 includes a pair of first cavity portions 62A corresponding to the pair of flange portions 40 illustrated in FIG. 2 and a second cavity portion 62B corresponding to the winding core portion 30. At this time, in the cavity 62, a width dimension w1 measured in the width direction Wd of the second cavity portion 62B is set to be, for example, 0.3 or more times and 0.6 or less times (i.e., from 0.3 times to 0.6 times) a width dimension W1 measured in the width direction Wd of the first cavity portion 62A.

As illustrated in FIG. 3, the lower punch assembly 70 has a structure in which the assembly is divided into a first lower punch 71 for molding the flange portions and a second lower punch 72 for molding the winding core portion. The first lower punch 71 and the second lower punch 72 are lowered and lifted by a first drive source 73 and a second drive source 74, respectively. Accordingly, the first lower punch 71 and the second lower punch 72 may be lowered and lifted independently of each other.

The upper punch assembly 80 has a structure in which the assembly is divided into a first upper punch 81 for molding the flange portions and a second upper punch 82 for molding the winding core portion. The first upper punch 81 and the second upper punch 82 are lowered and lifted by a first drive source 83 and a second drive source 84, respectively. Accordingly, the first upper punch 81 and the second upper punch 82 may be lowered and lifted independently of each other. As the drive sources 73, 74, 83, and 84, servo motors may be used, for example.

The feeder 90 configured to store a ferrite powder 95 and supply the powder to the cavity 62 has a box-like shape. The feeder 90 is so provided as to be movable in the left-right direction (lengthwise direction Ld) in FIG. 3 while making contact with the upper surface of the die 61.

The powder molding apparatus 60 is a powder molding apparatus of a multi-shaft press system (multistage press type). For example, with the die 61 being fixed, the punches 71, 72, 81, and 82 are driven independently of each other. The following processes are carried out by the powder molding apparatus 60.

First, the feeder 90 is moved to the upper side of the cavity 62 to supply the ferrite powder 95 from a cavity of the feeder 90 into the cavity 62, and the lower punch assembly 70 is lowered by a predetermined amount relative to the die 61. With this, the cavity 62 is filled with the ferrite powder 95 in excess of the finally-desired filling amount.

Subsequently, the lower punch assembly 70 is lifted relative to the die 61 to push back the excessive ferrite powder 95 into the feeder 90, and the cavity 62 is densely filled with the ferrite powder 95.

Next, the feeder 90 is returned to the position illustrated in FIG. 3. At this time, the ferrite powder 95 overflowing from the cavity 62 is scraped off by a side wall or the like of the feeder 90.

Subsequently, the upper punch assembly 80 is moved downward to enter into the cavity 62. At this time, in order to prevent the overflow of the ferrite powder 95, before the upper punch assembly 80 enters into the cavity 62, the lower punch assembly 70 is moved downward relative to the die 61 to a position illustrated in FIG. 5.

Next, as illustrated in FIG. 5, the ferrite powder 95 filled in a closed space surrounded by the lower punch assembly 70, the upper punch assembly 80, and the die 61 is pressed by the lower punch assembly 70 and the upper punch assembly 80 to mold a molded body 20A, by the first and second lower punches 71, 72 and the first and second upper punches 81, 82 being moved to approach each other.

At this time, in the powder molding apparatus 60, since each of the punches 71, 72, 81, and 82 is able to be driven independently, it is possible to individually control the movement amount of each of the punches 71, 72, 81, and 82 relative to the die 61. This makes it possible to freely adjust the pressing force, that is, the degree of compression, for each of the winding core portion 30 and the flange portions 40 in the molded body 20A.

Accordingly, by controlling the movement amount of each of the punches 71, 72, 81, and 82, it is easy to adjust a ratio t1/T1, which is the ratio of a dimension t1 of the winding core portion 30 along the pressing direction to a dimension T1 of the flange portion 40 along the pressing direction, in such a manner that the ratio t1/T1 satisfies a relation of $0.3 \leq t1/T1 \leq 0.6$, for example. Further, it is also easy to make the degree of compression at the flange portion 40 equal to the degree of compression at the winding core portion 30 by controlling the movement amount of each of the punches 71, 72, 81, and 82.

Thereafter, the lower punch assembly 70 and the upper punch assembly 80 are moved upward relative to the die 61, so that the molded body 20A is brought to the outside of the die 61. Then, the lower punch assembly 70 and the upper punch assembly 80 are separated from each other, so that the molded body 20A is taken out.

Next, the molded body 20A is fired in a firing furnace. By the firing, the ferrite sintered body 20 is achieved. Subsequently, the ferrite sintered body 20 is set in a barrel and polished with an abrasive material. By the barrel polishing, burrs are removed from the ferrite sintered body 20, so that curved-surface roundness is obtained on an outer surface (in particular, corners, ridge lines, and the like) of the ferrite sintered body 20.

Subsequently, the terminal electrodes 50 are each formed on the lower surface 46 of the flange portion 40 of the ferrite core 20 including the ferrite sintered body. For example, a conductive paste containing Ag or the like as a conductive ingredient is applied to the lower surface 46 of the flange portion 40, and then, baking treatment is performed to form an underlying metal layer. Thereafter, a nickel (Ni) plating film and a tin (Sn) plating film are sequentially formed on the underlying metal layer by electroplating, so that the terminal electrode 50 is formed. The terminal electrode 50 may be configured to include a member obtained by processing a metal plate.

Next, the winding wire 55 is wound around the winding core portion 30 of the ferrite core 20, and the end portion of the winding wire 55 is joined to the terminal electrode 50 by a known technique such as thermal pressure bonding. In this way, the coil component 1 is completed.

The ferrite sintered body 20 may be made of any ferrite material in accordance with the required characteristics, for example, such as a Ni—Cu—Zn based ferrite, Ni—Zn based ferrite, Cu—Zn—Mg based ferrite, Cu—Zn based ferrite, Mn—Mg—Zn based ferrite, and Mn—Zn based ferrite.

Pores are present inside the ferrite core 20 including the ferrite sintered body, that is, present in the interior of each of the winding core portion 30 and the flange portions 40. The present disclosure has a feature that the porosity in the winding core portion 30 is equal to or more than about 0.05% and equal to or less than about 1.00% (i.e., from about 0.05% to about 1.00%). The porosity was obtained as follows.

By using an ion milling apparatus (IM4000: manufactured by Hitachi High-Tech Corporation), the ferrite core 20 to be evaluated was subjected to polishing treatment, and then a cross section of a substantially central portion of the winding core portion 30 as a portion to be evaluated, was exposed. Subsequently, by using a scanning electron microscope (S-4800: manufactured by Hitachi High-Tech Corporation), six portions in the exposed cross section were photographed by using secondary electron beams in a range of about 95 μm by about 126 μm per field of view under the conditions of an acceleration voltage of about 1 kV, a measurement time of about 20 seconds, a magnification of about 1000 times, and image pixels of about 1260 by about 880. Next, by using image analysis software (A-Zo-Kun: manufactured by Asahi Kasei Engineering Corporation), pores in the photographed images were extracted by particle extraction, the total area of the pores was calculated by performing binarization processing thereupon, and then a pore area ratio was calculated from the total area of the pores. The pore area ratio was taken as the porosity.

To be specific, the binarization processing was performed as follows. First, contrasting density (light intensity) of each pixel of the photographed images is calculated in a rational number, and the rational number is converted to a value in 256 stages (eight bits) from 0 (dark) to 255 (light), and the converted value is taken as a gray-scale value. Next, a gray-scale value and its frequency (the number of pixels) of each image is denoted by a histogram. At this time, an image in which D50 of the gray-scale value does not come to be 75 to 125 is discarded as an analysis image. Further, "D90 to D10" of the gray-scale value of the image is set as a spread value of the gray-scale value, and an image in which the spread value does not come to be 20 to 35 is also discarded as an analysis image. In a case where the number of photographed images where D50 of the gray-scale value comes to be 75 to 125 and the spread value comes to be 20 to 35 is less than six, the photographing conditions are reconsidered.

Regarding the analysis images selected as described above, an accumulation curved line from a gray-scale value 0 of the frequency (the number of pixels) is calculated in the histogram discussed above, and a first approximate straight line and a second approximate straight line are drawn as follows with respect to the accumulation curved line.

First approximate straight line: a straight line that connects a point corresponding to D30 of the accumulation curved line and a point corresponding to D40 thereof.

Second approximate straight line: a line that connects a point on the accumulation curved line corresponding to a gray-scale value indicating a value obtained by subtracting 30 from a gray-scale value at a point corresponding to D10 of the accumulation curved line, and a point on the accumulation curved line corresponding to a gray-scale value indicating a value obtained by subtracting 40 from the gray-scale value at the point corresponding to D10 of the accumulation curved line.

Then, a gray-scale value at a point where a bisector of the first and second approximate straight lines intersects with the accumulation curved line is defined as a threshold value of the binarization processing. That is, a pixel having a gray-scale value equal to or smaller than a gray-scale value to be the threshold value is determined as a pore, and a pore area ratio is calculated based on the number of pixels; thus, the calculated pore area ratio is taken as a porosity.

When the porosity is equal to or less than about 1.00%, it is possible to satisfactorily achieve both the degree of freedom in design of the ferrite core shape and the mechanical strength thereof. When the porosity is equal to or less than about 0.70%, it is possible to remarkably reduce a risk that the base of the winding core portion is broken off during the manufacturing process even in the case where the winding core portion takes a thinned shape. When the porosity is equal to or less than about 0.50%, it is possible to satisfy strict reliability test conditions. Accordingly, as described above, although the porosity of the winding core portion 30 is set to be equal to or less than about 1.00%, it is more preferable for the porosity thereof to be further lowered to be equal to or less than about 0.70%, and most preferable to be equal to or less than about 0.50%.

FIGS. 8A to 8D show SEM images of cross sections of several ferrite sintered bodies actually produced. Ferrite sintered bodies shown in FIGS. 8A to 8D were manufactured and porosities thereof were measured. As a result, the ferrite sintered body of FIG. 8A had a porosity of about 0.1%, the ferrite sintered body of FIG. 8(B) had a porosity of about 0.4%, the ferrite sintered body of FIG. 8C had a porosity of about 2.4%, and the ferrite sintered body of FIG. 8D had a porosity of about 3.0%. In FIGS. 8A to 8D, those that appear to be black spots are pores.

Figure 8A:
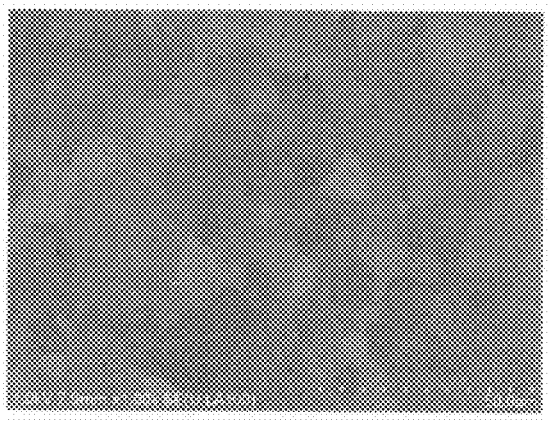
FIGS. 8A to 8D are views each showing a SEM image of a cross section of a ferrite sintered body, where
Figure 8B:
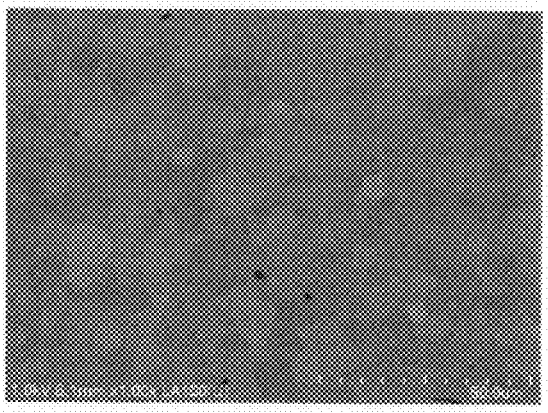
Figure 8C:
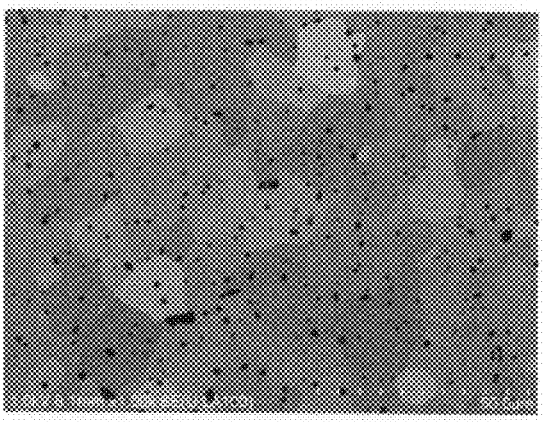
Figure 8D:
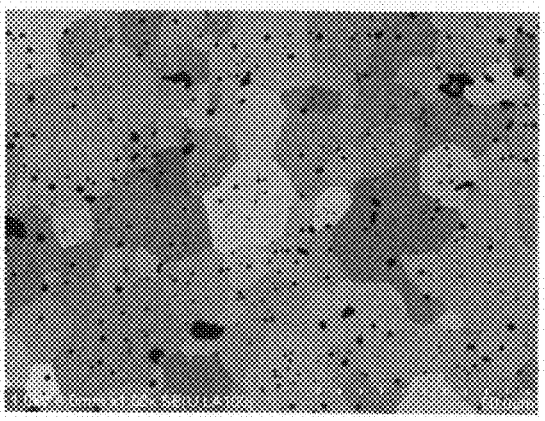

As is understood by comparing FIGS. 8A to 8D with one another, the pores of FIG. 8D are largest in size and number, and the pores of FIGS. 8D, 8C, 8B, and 8A become smaller in size and number in that order. That is, the pores of FIG. 8A are smallest in size and number.

Three-point bending strength of a ferrite sintered body formed in a plate-like shape having a length of about 7.0 mm, a width of about 27.5 mm, and a thickness of about 1 mm was measured, and the measured strength was compared with that of a ferrite sintered body corresponding to a product of related art having a porosity of equal to or more than about 2.5%. The comparison result was as follows:

(1) In a ferrite sintered body having a porosity of more than about 0.70% and equal to or less than about 1.00% (i.e., from about 0.70% to about 1.00%), enhancement in strength by about 15% was confirmed;

(2) In a ferrite sintered body having a porosity of more than about 0.50% and equal to or less than 0.70% (i.e., from about 0.50% to 0.70%), enhancement in strength by about 39% was confirmed; and (3) In a ferrite sintered body having a porosity of more than 0.05% and equal to or less than about 0.50% (i.e., from 0.05% to about 0.50%), enhancement in strength by about 82% was confirmed.

In a ferrite sintered body having a porosity of equal to or less than about 0.05%, an effect of enhancement in strength exceeding that of the case (3) described above was not confirmed. The reason for this may be such that fracture origins changed from the pores inside the ferrite sintered body to the pores on the surface thereof. Accordingly, it is unnecessary to forcefully make a porosity equal to or less than about 0.05%, and it is sufficient that the porosity has a value more than about 0.05%.

In order to enhance the strength of the ferrite core 20, it is preferable to enhance not only the strength of the winding core portion 30 but also the strength of the flange portions 40. It is difficult for the flange portions 40 to decrease the porosity due to the constraints of powder molding in comparison with the winding core portion 30; on the other hand, since the porosity of the flange portions 40 has less influence on the strength, characteristics, and the like than that of the winding core portion 30, it is preferable to set the porosity to be slightly higher than that of the winding core portion 30 from a practical standpoint. Therefore, the porosity in the flange portions 40 is preferably about 0.20% higher than that in the winding core portion 30. More specifically, it is preferable for the porosity in the flange portions 40 to be equal to or more than about 0.05% and equal to or less than about 1.20% (i.e., from about 0.05% to about 1.20%), is more preferable to be equal to or less than about 0.84%, and most preferable to be equal to or less than about 0.60%.

The measurement of the porosity in the flange portions 40 may be carried out by the same method as the measurement of the porosity in the winding core portion 30 described above, except that a cross section at a substantially central portion of the flange portion 40 is taken as an evaluation portion.

It has been confirmed that the above-discussed porosities, more specifically, the porosities as shown in FIGS. 8A to 8D discussed above may be achieved by adopting the following firing profiles, as an example, in order to obtain the ferrite sintered body 20.

(1) When a firing profile was adopted in which the temperature was raised from 600° C. to 1200° C. in 25 hours and thereafter the temperature was lowered to 600° C. in 25 hours, the porosity of the winding core portion 30 was equal to or more than about 0.05% and equal to or less than about 1.00% (i.e., from about 0.05% to about 1.00%), and the porosity of the flange portions 40 was equal to or more than about 0.05% and equal to or less than about 1.20% (i.e., from about 0.05% to about 1.20%).

(2) When a firing profile was adopted in which the temperature was raised from 600° C. to 1200° C. in 80 hours and thereafter the temperature was lowered to 600° C. in 80 hours, the porosity of the winding core portion 30 was equal to or more than about 0.05% and equal to or less than about 0.70% (i.e., from about 0.05% to about 0.70%), and the porosity of the flange portions 40 was equal to or more than about 0.05% and equal to or less than about 0.84% (i.e., from about 0.05% to about 0.84%).

(3) When a firing profile was adopted in which the temperature was raised from 600° C. to 1200° C. in 210 hours and thereafter the temperature was lowered to 600° C. in 210 hours, the porosity of the winding core portion 30 was equal to or more than about 0.05% and equal to or less than about 0.50% (i.e., from about 0.05% to about 0.50%), and the porosity of the flange portions 40 was equal to or more than about 0.05% and equal to or less than about 0.60% (i.e., from about 0.05% to about 0.60%).

It is assumed that, when a significantly long time, such as 25 hours, 80 hours, or 210 hours was taken for the temperature raising process from 600° C. to 1200° C., as described above, the time until the completion of the sintering became long, so that the time to discharge the air forming the pores was able to be sufficiently secured, whereby it was managed to lower the porosity. The above-described ferrite sintered body corresponding to the product of related art having the porosity of equal to or more than about 2.5% was obtained by raising the temperature from 600° C. to 1200° C. at a rate of 4° C./min.

The control of the porosities by the above-described firing profiles are merely an example, and the same effect may be achieved even when the desired porosity is set by another method. Therefore, the ferrite core 20 with a porosity of equal to or less than about 1.00% in the winding core portion 30 may be achieved by a method other than the method employing the above-described firing profiles.

The ferrite sintered body constituting the ferrite core 20 with a porosity of equal to or less than about 1.00% in the winding core portion 30 exhibited high density such as about 5.2 g/cm$^3$ or more and about 5.4 g/cm$^3$ or less (i.e., from about 5.2 g/cm$^3$ to about 5.4 g/cm$^3$). By obtaining the density of about 5.2 g/cm$^3$ or more and about 5.4 g/cm$^3$ or less (i.e., from about 5.2 g/cm$^3$ to about 5.4 g/cm$^3$) as described above, an effect of lowering the porosity to a value equal to or less than about 1.00% is remarkably exhibited, and the density may be determined by using the Archimedes method.

Referring to FIG. 2, a length dimension L of the ferrite core, that is, of the ferrite sintered body 20 when measured in the lengthwise direction Ld, is preferably equal to or more than about 0.2 mm and equal to or less than about 6.0 mm (i.e., from about 0.2 mm to about 6.0 mm). The ferrite core 20 having such a relatively small dimension tends to have a low mechanical strength, and therefore it is meaningful for the ferrite core 20 to lower the porosity thereof to enhance the mechanical strength.

Regarding the dimensions measured in the width direction Wd of the ferrite sintered body 20, a dimension w of the winding core portion 30 is preferably about 0.3 or more times and about 0.6 or less times (i.e., from about 0.3 times to about 0.6 times) a dimension W of the flange portion 40. Likewise, regarding the dimensions measured in the height direction Td of the ferrite sintered body 20, a dimension t of the winding core portion 30 is preferably about 0.3 or more times and about 0.6 or less times (i.e., from about 0.3 times to about 0.6 times) a dimension T of the flange portion 40. When such a dimensional relationship is selected, it is possible to cause steps between the winding core portion 30 and the flange portion 40 in the height direction Ld and the width direction Wd respectively to be large, thereby making it possible to secure a wide area where the winding wire 55 may be disposed around the winding core portion 30.

Second Embodiment

Figure 6:
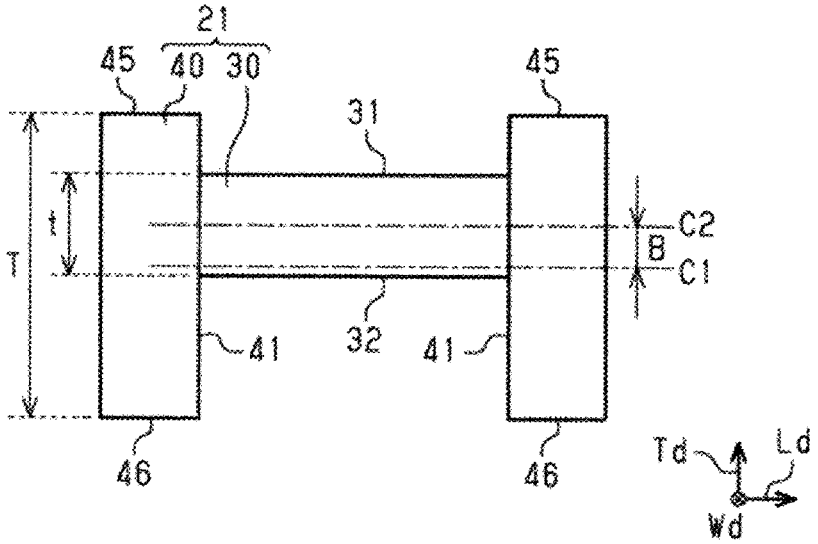
FIG. 6 is a front view illustrating a ferrite core according to a second embodiment of the present disclosure.

Referring to FIG. 6, a ferrite core 21 has an asymmetrical shape in the up-down direction, and a winding core portion 30 of the ferrite core 21 is provided at a position shifted from a center C1 in a height direction Td of a flange portion 40. More specifically, a center C2 of the winding core portion 30 in the height direction Td is provided at a position shifted upward from the center C1 in the height direction Td of the flange portion 40. A shift amount B between the center C2 of the winding core portion 30 and the center C1 of the flange portion 40 may be set to be about 0.01 mm to about 0.025 mm, for example.

According to the present embodiment, the terminal electrode 50 (see FIG. 1) is formed on a lower surface 46 of the flange portion 40. That is, the terminal electrode 50 is formed on the lower surface 46, which is arranged on the opposite side to a side where the winding core portion 30 is displaced relative to the center C1. Because of this, it is possible to cause a separation distance between the winding core portion 30 and the terminal electrode 50 to be wide in comparison with the case where the center C2 of the winding core portion 30 and the center C1 of the flange portion 40 coincide with each other. This makes it possible to secure a wide formation area of the terminal electrode 50. In addition, it is possible to widen a separation distance between the winding wire 55 (see FIG. 1) wound around the winding core portion 30 and the terminal electrode 50. This makes it possible to cause a short circuit failure to be unlikely to occur between the winding wire 55 wound around the winding core portion 30 and the terminal electrode 50. Further, for example, when the coil component is mounted on a circuit substrate, the winding wire 55 wound around the winding core portion 30 may be distanced from a circuit pattern on the circuit substrate. This may make an eddy current unlikely to be generated in the circuit pattern due to the winding wire 55 of the coil component, so that a decrease in Q value due to the increase in eddy-current loss may be suppressed.

Moreover, when the ferrite core 21 is formed in an asymmetrical shape in the up-down direction, it is difficult to control the pressure during the powder press molding, and the winding core portion 30 is easily broken off. Therefore, the effect of enhancing the strength by lowering the porosity according to the preferred embodiments of the present disclosure is further meaningful.

The ferrite core 21 may be manufactured by a manufacturing method substantially similar to that of the manufacturing method of the first embodiment.

Third Embodiment

Figure 7:
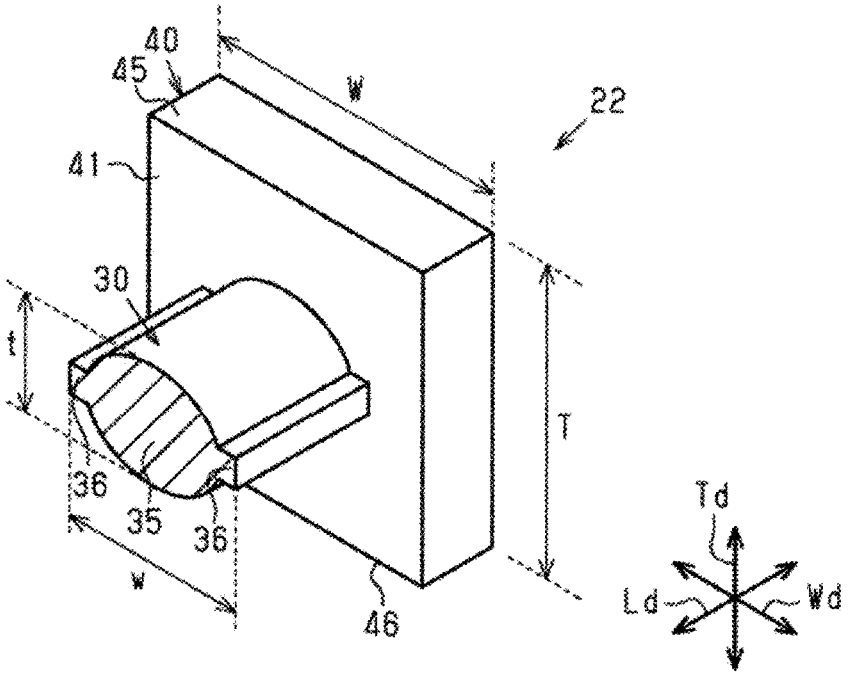
FIG. 7 is a perspective view illustrating part of a ferrite core according to a third embodiment of the present disclosure.

Referring to FIG. 7, a winding core portion 30 of a ferrite core 22 includes a main body portion 35, in which a cross-sectional shape orthogonal to a lengthwise direction Ld has an elliptical shape or an approximately elliptical shape and a major axis direction of the cross section faces a width direction Wd, and also includes ribs 36 protruding outward from both end portions in the width direction Wd of the main body portion 35. The ribs 36 are provided to prevent breakage of punches during the manufacturing process.

In the ferrite core 22, since the cross section of the winding core portion 30 orthogonal to the lengthwise direction Ld is formed in an elliptical shape or a substantially elliptical shape, it is easy to wind the winding wire 55 (see FIG. 1) around the winding core portion 30, and it is possible to make the winding wire 55 unlikely to break when the winding wire 55 is wound.

When the cross section of the winding core portion 30 has a simple circular shape, it is considerably difficult to achieve the winding core portion 30 by powder press molding. However, by providing the ribs 36 in the winding core portion 30 as in the present embodiment, it becomes easier to achieve the reduction in the porosity.

In the present embodiment, a ratio t/T, which is the ratio of a maximum dimension t along a height direction Td of the winding core portion 30 to a height dimension T of a flange portion 40, preferably satisfies a relation of $0.3 \leq t/T \leq 0.6$, and a ratio w/W, which is the ratio of a maximum dimension w along the width direction Wd of the winding core portion 30 to a width dimension W of the flange portion 40, preferably satisfies a relation of $0.3 \leq w/W \leq 0.6$.

The ferrite core 22 may be manufactured by a manufacturing method substantially similar to that of the manufacturing method of the first embodiment.

Although the present disclosure has been described in connection with the embodiments illustrated in the drawings, various kinds of other embodiments are possible to be carried out within the scope of the present disclosure.

For example, the embodiments described above relate to a ferrite core included in a coil component having a single wire. However, the present disclosure may also be applied to a ferrite core included in a coil component having a plurality of wires, such as a coil component constituting a common mode choke coil or a coil component constituting a transformer. The present disclosure is also applicable to a ferrite core included in a winding wire-type electronic component (for example, an antenna) other than the coil component.

In the case of constituting a coil component, the coil component may further include a plate-like core 130 configured to connect a pair of flange portions provided in a ferrite core. With this constitution, it is possible to configure a closed magnetic path in which magnetic flux circulates. In addition, resin coating may be carried out to connect upper surfaces of the pair of flange portions.

The ferrite cores illustrated in the drawings are ferrite cores applied to the coil component of a lateral winding type, but the present disclosure is also applicable to a ferrite core applied to a coil component of a longitudinal winding type.

Note that the present disclosure also covers embodiments obtained by partial replacement, combination, or the like of the configurations between the different embodiments described above.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A ferrite core comprising:

a ferrite sintered body in which integrally formed are a winding core portion, extending in a lengthwise direction, and flange portions provided at both ends in the lengthwise direction of the winding core portion and projecting from the winding core portion in a height direction orthogonal to the lengthwise direction, wherein pores are present inside the winding core portion and the flange portions, and an abundance ratio of the pores in the winding core portion is from about 0.05% to about 1.00%.

2. The ferrite core according to claim 1, wherein the abundance ratio of the pores in the winding core portion is equal to or less than about 0.70%.

3. The ferrite core according to claim 2, wherein the abundance ratio of the pores in the winding core portion is equal to or less than about 0.50%.

4. The ferrite core according to claim 1, wherein the abundance ratio of the pores in the flange portions is from about 0.05% to about 1.20%.

5. The ferrite core according to claim 4, wherein the abundance ratio of the pores in the flange portions is equal to or less than about 0.84%.

6. The ferrite core according to claim 5, wherein the abundance ratio of the pores in the flange portions is equal to or less than about 0.60%.

7. The ferrite core according to claim 1, wherein density of the ferrite sintered body is from about 5.2 $g/cm^3$ to about 5.4 $g/cm^3$.

8. The ferrite core according to claim 1, wherein a dimension of the winding core portion measured in the height direction is from about 0.3 times to about 0.6 times a dimension of the flange portion.

9. The ferrite core according to claim 1, wherein the flange portion projects from the winding core portion in the height direction and in a width direction orthogonal to both the lengthwise direction and the height direction.

10. The ferrite core according to claim 9, wherein each of a dimension of the winding core portion measured in the height direction and a dimension of the winding core portion measured in the width direction is about 0.3 times to 0.6 times the dimension of the flange portion.

11. The ferrite core according to claim 1, wherein a dimension of the ferrite sintered body measured in the lengthwise direction is from about 0.2 mm to about 6.0 mm.

12. The ferrite core according to claim 1, further comprising:

terminal electrodes formed on one side in the height direction of the flange portions.

13. A winding coil component comprising:

the ferrite core according to claim 12; and a winding wire disposed on the winding core portion, wherein both ends of the winding wire are electrically connected to the terminal electrodes.

14. The winding coil component according to claim 13, further comprising:

a plate-like core disposed on the other side in the height direction of the flange portions.

15. The ferrite core according to claim 2, wherein the abundance ratio of the pores in the flange portions is from about 0.05% to about 1.20%.

16. The ferrite core according to claim 2, wherein density of the ferrite sintered body is from about 5.2 $g/cm^3$ to about 5.4 $g/cm^3$.

17. The ferrite core according to claim 2, wherein a dimension of the winding core portion measured in the height direction is from about 0.3 times to about 0.6 times a dimension of the flange portion.

18. The ferrite core according to claim 2, wherein the flange portion projects from the winding core portion in the height direction and in a width direction orthogonal to both the lengthwise direction and the height direction.

19. The ferrite core according to claim 2, wherein a dimension of the ferrite sintered body measured in the lengthwise direction is from about 0.2 mm to about 6.0 mm.

20. The ferrite core according to claim 2, further comprising:

terminal electrodes formed on one side in the height direction of the flange portions.

* * * * *